US009409421B1

(12) United States Patent
Seng et al.

(10) Patent No.: US 9,409,421 B1
(45) Date of Patent: Aug. 9, 2016

(54) PRINTER APPARATUS

(71) Applicant: TOSHIBA TEC KABUSHIKI KAISHA, Shinagawa-ku, Tokyo (JP)

(72) Inventors: Ooi In Seng, Singapore (SG); Toshiharu Sekino, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/789,022

(22) Filed: Jul. 1, 2015

(51) Int. Cl.

| | |
|---|---|
| ***B41J 2/01*** | (2006.01) |
| ***B41J 11/04*** | (2006.01) |
| ***B41J 11/02*** | (2006.01) |
| *B41J 11/00* | (2006.01) |
| *B41J 11/06* | (2006.01) |

(52) U.S. Cl.
CPC *B41J 11/04* (2013.01); *B41J 11/02* (2013.01); *B41J 11/0045* (2013.01); *B41J 11/06* (2013.01)

(58) Field of Classification Search
None
See application file for complete search history.

(56) References Cited

U.S. PATENT DOCUMENTS 6,118,469 A * 9/2000 Hosomi ..... B26D 1/305 347/222
2013/0293655 A1 11/2013 Sekino et al.

* cited by examiner

*Primary Examiner* — Lisa M Solomon
(74) *Attorney, Agent, or Firm* — Amin, Turocy & Watson LLP; Gregory Turocy

(57) ABSTRACT

In accordance with one embodiment, a printer apparatus comprises a main body section configured to include a first printer cover; an opening and closing unit configured to include a second printer cover which is fixed to be rotatable with respect to the main body section; a print head configured to be held by the main body section; a platen roller configured to be held by the opening and closing unit and arranged at a position opposite to the print head in a closing state of the second printer cover; and a platen roller moving mechanism configured to move the platen roller away from the position opposite to the print head in an opening state of the second printer cover.

8 Claims, 3 Drawing Sheets

PRINTER APPARATUS

FIELD

Embodiments described herein relate generally to a printer apparatus which carries out printing on paper and then issues the printed paper.

BACKGROUND

In a printer apparatus used as a receipt issuing apparatus and the like, pre-determined items are printed on long-sized roll paper drawn out from paper wound into a roll shape. It is necessary to replenish the roll paper newly in a case in which the roll paper is used up. However, in a case of carrying out paper replenishment, it is necessary to nip the front end of the replenished roll paper between a print head which carries out printing on the roll paper and a platen roller arranged opposite to the print head. Thus, there is known a method that the roll paper is loaded into the printer apparatus main body in a state of being placed in a cassette. In a case of replenishing the roll paper, the front end of the replenished roll paper can be nipped easily if the print head and the platen roller are separated from each other. However, even if the print head and the platen roller are separated from each other, if the platen roller exists in the replenishment path of the roll paper, a user has to avoid the platen roller to replenish the roll paper, which may lead to a problem that only the roll paper having a small diameter can be replenished.

DETAILED DESCRIPTION

In accordance with one embodiment, a printer apparatus comprises a main body section configured to include a first printer cover; an opening and closing unit configured to include a second printer cover which is fixed to be rotatable with respect to the main body section; a print head configured to be held by the main body section; a platen roller configured to be held by the opening and closing unit and arranged at a position opposite to the print head in a closing state of the second printer cover; and a platen roller moving mechanism configured to move the platen roller away from the position opposite to the print head in an opening state of the second printer cover.

Hereinafter, the printer apparatus according to the present embodiment is described in detail with reference to the accompanying drawings.

Figure 1:
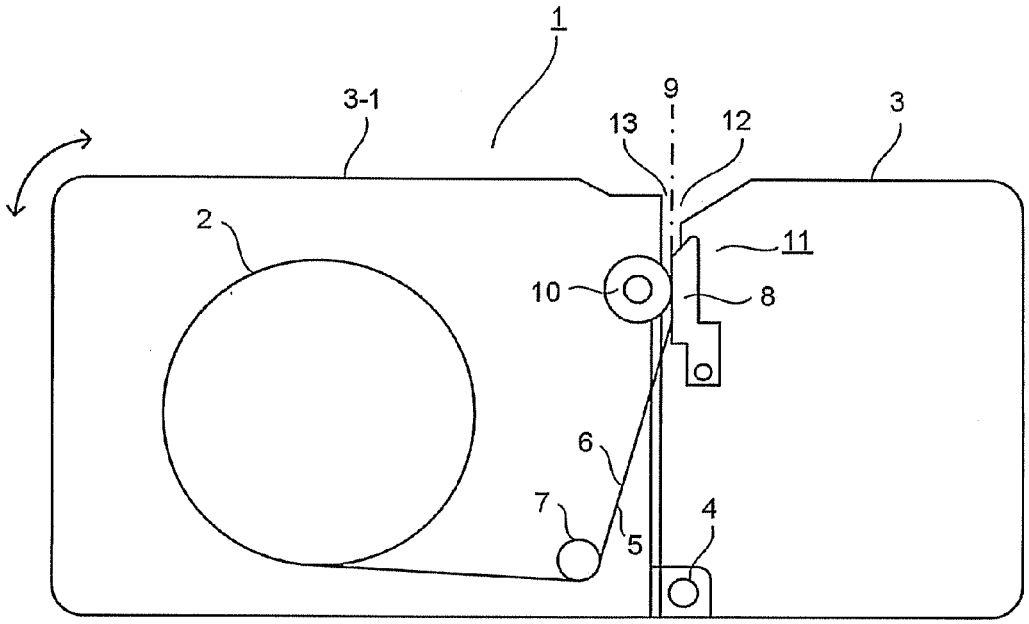
FIG. 1 is a constitution diagram illustrating the main portions of a printer apparatus according to a first embodiment.

FIG. 1 is a constitution diagram illustrating the main portions of a printer apparatus 1 according to the present embodiment. In the printer, the paper is conveyed from the lower side towards the upper side in FIG. 1, thus, the lower side in FIG. 1 is referred to as upstream side and the upper side in FIG. 1 is referred to as downstream side.

A reference numeral 2 in FIG. 1 indicates wound roll paper. The printer apparatus 1 includes a printer cover 3 and a printer cover 3-1, and the printer cover 3 is fixed at the printer apparatus 1. The printer cover 3-1 can be opened and closed in a direction indicated by an arrow shown in FIG. 1 around a rotation shaft 4, and when the printer cover 3-1 is opened, the roll paper 2 is loaded into the printer apparatus 1.

The roll paper 2 includes a first paper surface 5 and a second paper surface 6 opposite to the first paper surface 5, and a thermosensitive layer which generates color if heated is arranged on the first paper surface 5 only.

An idler roller 7 which applies tension to the conveyed roll paper 2 is supported in the printer apparatus 1 in a rotatable manner.

At the downstream side of the idler roller 7 are arranged a thermal print head 8 and a platen roller 10 opposite to the thermal print head 8 across a paper conveyance path 9. The platen roller 10 is driven to rotate by a motor (not shown). A printing section 11 consisting of the thermal print head 8 and the platen roller 10 carries out printing on the first paper surface 5 of the roll paper 2.

The printer apparatus 1 further includes a paper discharge port 12 at the downstream side of the printing section 11, and the printed roll paper 2 is discharged to the outside of the printer apparatus 1 from the paper discharge port 12. Further, a paper cutting edge 13 is arranged nearby the paper discharge port 12, and a user cuts the printed roll paper 2 manually using the paper cutting edge 13. In addition, it is exemplified in the present embodiment that the printed roll paper 2 is cut using the paper cutting edge 13; however, it is not limited to this. For example, a cutter may be arranged at the downstream side of the printing section 11 in the paper conveyance direction to cut the roll paper 2.

Next, a platen roller moving mechanism is described with reference to FIG. 2-FIG. 4.

Figure 2:
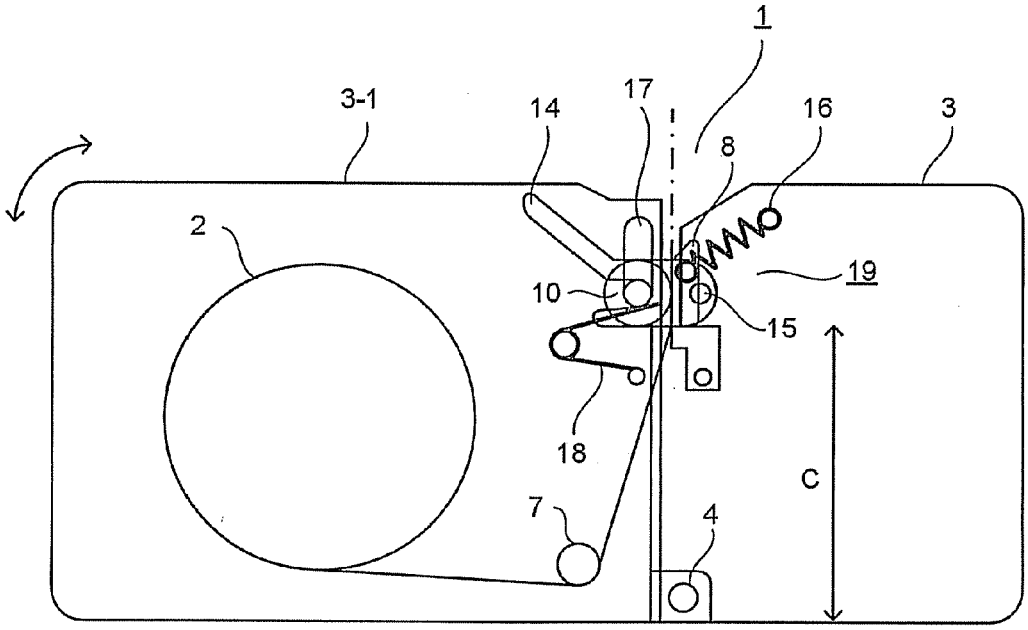
FIG. 2 is a constitution diagram illustrating the main portions of a platen roller moving mechanism in a printing state of the printer apparatus according to the first embodiment.

FIG. 2 is a constitution diagram illustrating the main portions of a platen roller moving mechanism 19 in a printing state of the printer apparatus 1. FIG. 3 is a constitution diagram illustrating the main portions in a platen roller moving state of the platen roller moving mechanism 19. FIG. 4 is a diagram illustrating the position of the platen roller moving mechanism 19 during the replenishment of the roll paper 2 to the printer apparatus 1.

The platen roller moving mechanism 19 is arranged nearby the platen roller 10. The platen roller moving mechanism 19 consists of a rotation shaft 15, a substantially U-shaped platen holder 14 of which one part extends obliquely, a holder spring 16, a long hole 17 and a platen spring 18.

As shown in FIG. 2, in a state in which printing is carried out, the shaft of the platen roller 10 is arranged at the printer cover 3-1 and inserted into the long hole 17 arranged at a frame (not shown), and is positioned at the lower end of the long hole 17. The shaft of the platen roller 10 is inserted into the inside of the substantial U-shape of the platen holder 14, and the platen roller 10 is positioned opposite to a heat generating section of the thermal print head 8. In this state, the printer cover 3 and the printer cover 3-1 are fixed through a hook (not shown).

In a case of replenishing the roll paper 2 due to paper out and the like, the user of the printer apparatus 1 opens the hook (not shown) to release the fixation of the printer cover 3 and the printer cover 3-1.

Figure 3:
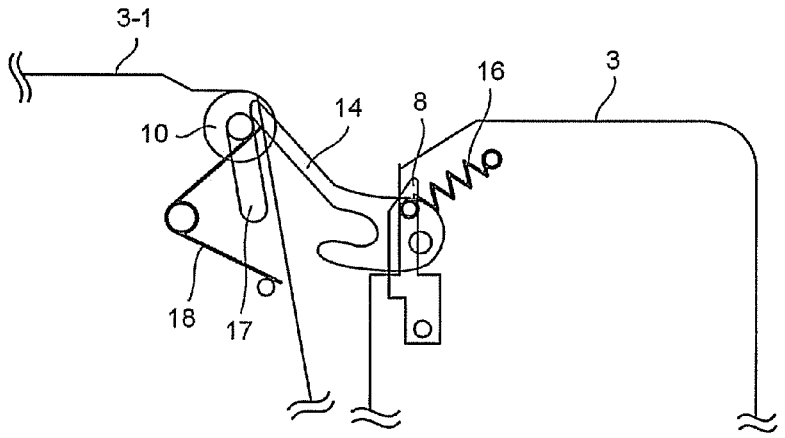
FIG. 3 is a constitution diagram illustrating the main portions in a platen roller moving state of the platen roller moving mechanism according to the first embodiment.
Figure 4:
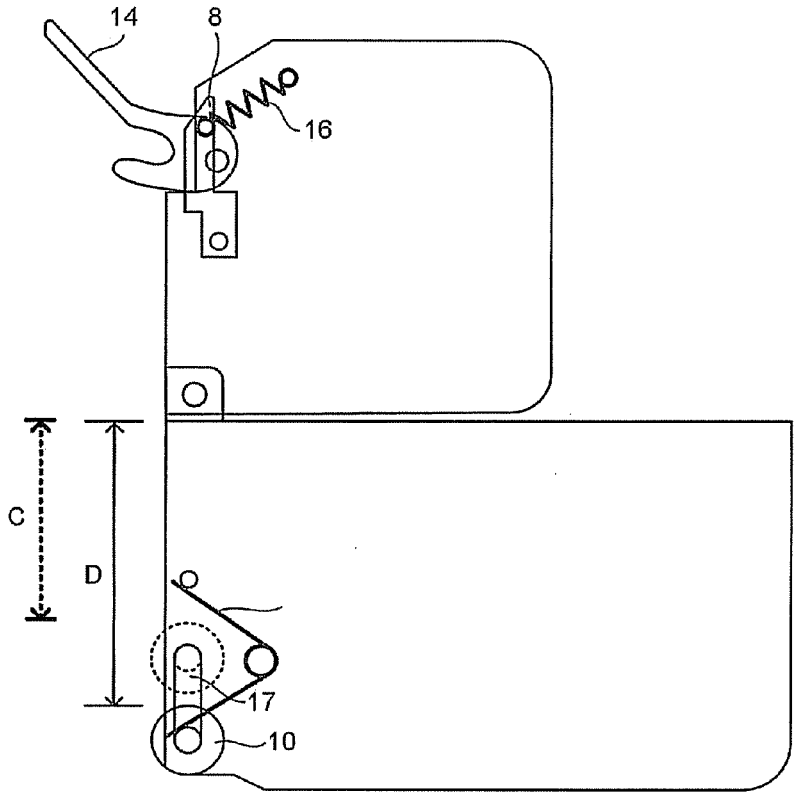
FIG. 4 is a diagram illustrating the position of the platen roller moving mechanism during the paper replenishment to the printer apparatus according to the first embodiment.

The platen holder 14 is energized in a clockwise direction in FIG. 3 around the rotation shaft 15 by the holder spring 16. The platen roller 10 is energized upwards in FIG. 3 by the platen spring 18. When the fixation of the printer cover 3 and the printer cover 3-1 is released, the shaft of the platen roller 10 is released from the insertion into the inside of the substantial U-shape of the platen holder 14, and is moved to the upper end of the long hole 17 along the part of the substantial U-shape which extends obliquely. Such a state is shown in FIG. 3. The printer cover 3-1, if further rotated, is turned into the state shown in FIG. 4. In this state, the user of the printer apparatus 1 replenishes the roll paper 2 and pulls the front end of the paper to the position between the thermal print head 8 and the platen roller 10, and then closes the printer cover 3-1. During the closing process, the shaft of the platen roller 10 is moved along the part of the substantial U-shape of the platen holder 14 which extends obliquely and then inserted into the substantial U-shape part, and meanwhile, the shaft of the platen roller 10 is moved to the lower end part of the long hole 17, and then the printer cover 3 and the printer cover 3-1 are fixed by the hook (not shown).

As stated above, in a case of replenishing the roll paper 2, the fixation of the printer cover 3 and the printer cover 3-1 is released, and the printer cover 3-1 is rotated. The platen roller moving mechanism 19 is arranged in the printer apparatus 1, and the platen roller 10 is moved as the printer cover 3-1 is rotated.

If there is no platen roller moving mechanism 19 arranged in the printer apparatus 1, the diameter of the roll paper 2 that can be replenished is C. In contrast, the diameter of the roll paper 2 that can be loaded into the printer apparatus 1 provided with the platen roller moving mechanism according to the present embodiment is D shown in FIG. 4. For reference, the diameter C serving as the diameter of the roll paper 2 that can be replenished to the printer apparatus 1 provided with no platen roller moving mechanism is also shown by a dashed line in FIG. 4. With the platen roller moving mechanism 19, diameter C<diameter D, and it is possible to replenish the roll paper 2 having a longer diameter.

A Second Embodiment

Hereinafter, the second embodiment is described with reference to FIG. 5 and FIG. 6. In the first embodiment, the printer cover 3 and the printer cover 3-1 are rotated around the rotation shaft 4; however, in the second embodiment, there is arranged a plurality of rotation centers.

Figure 5:
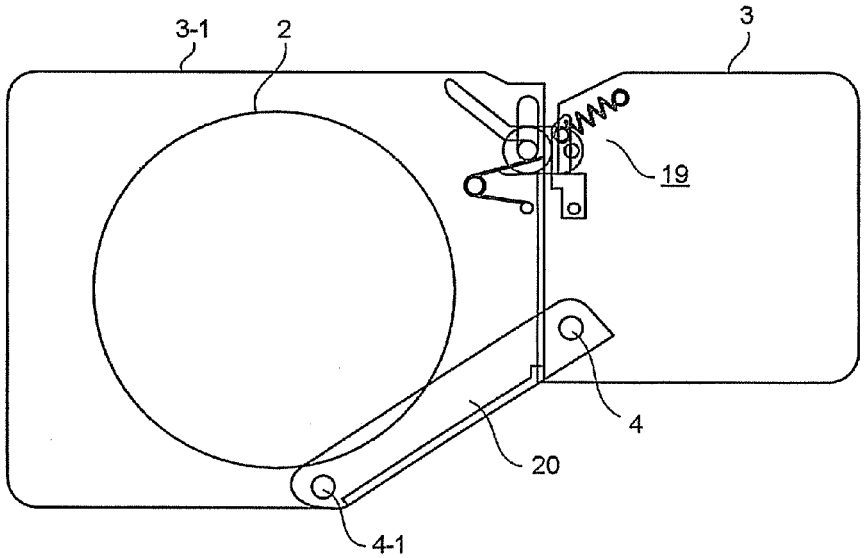
FIG. 5 is a constitution diagram illustrating the main portions of a platen roller moving mechanism in a printing state of the printer apparatus according to a second embodiment.
Figure 6:
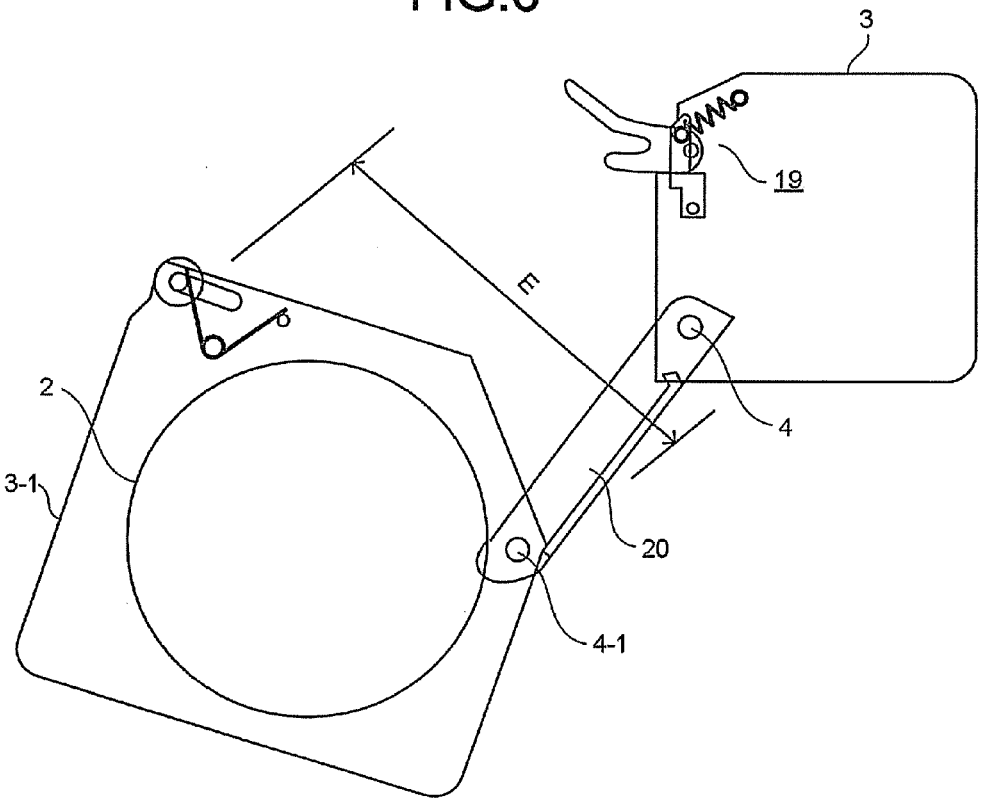
FIG. 6 is a constitution diagram illustrating the main portions in a platen roller moving state of the platen roller moving mechanism according to the second embodiment.

FIG. 5 shows a printing state and FIG. 6 shows an opening state. In the second embodiment, an opening arm 20, the rotation shaft 4 and a rotation shaft 4-1 are arranged. In this way, a diameter E of the roll paper 2 that can be loaded into the printer apparatus 1 provided with a plurality of rotation centers is longer than both of the diameter C of the roll paper 2 that can be loaded into the printer apparatus 1 provided with no platen roller moving mechanism and the diameter D of the roll paper 2 that can be loaded into the printer apparatus 1 provided with one rotation shaft 4; that is, C<D<E, and it is possible to load the roll paper 2 having a longer diameter.

Further, for the user of the printer apparatus 1 who desires to use the loaded roll paper 2 having a longer diameter, it is possible to cope with the situation only by changing the part of the printer cover 3-1 merely, and the printer cover 3 may be common no matter what kind of roll paper 2 is used.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus comprising:

a main body section configured to include a first printer cover;

an opening and closing unit configured to include a second printer cover which is fixed to be rotatable with respect to the main body section;

a print head configured to be held by the main body section;

a platen roller configured to be held by the opening and closing unit and arranged at a position opposite to the print head in a closing state of the second printer cover; and a platen roller moving mechanism configured to move the platen roller away from the position opposite to the print head in an opening state of the second printer cover, wherein the platen roller moving mechanism moves the platen roller to a position where the platen roller does not interfere with the replenishment of paper in the opening state of the second printer cover.

2. The printer apparatus according to claim 1, wherein the position where the platen roller does not interfere with the replenishment of paper is at the downstream side of the print head in a paper conveyance direction.

3. The printer apparatus according to claim 1, wherein the second printer cover is rotated around a rotation shaft.

4. The printer apparatus according to claim 1, wherein a plurality of rotation shafts is arranged.

5. A printer apparatus comprising:

a main body section configured to include a first printer cover;

an opening and closing unit configured to include a second printer cover which is fixed to be rotatable with respect to the main body section;

a print head configured to be held by the main body section;

a platen roller configured to be held by the opening and closing unit and arranged at a position opposite to the print head in a closing state of the second printer cover;

a discharge port configured at the downstream side of the print head and the platen roller in the paper conveyance direction to discharge the paper; and a platen roller moving mechanism configured to move the platen roller from the position opposite to the print head towards the side of the discharge port in an opening state of the second printer cover.

6. The printer apparatus according to claim 5, wherein the second printer cover is rotated around a rotation shaft.

7. The printer apparatus according to claim 5, wherein a plurality of rotation shafts is arranged.

8. The printer apparatus according to claim 5, wherein the platen roller moving mechanism is configured to move the platen roller from the position opposite to the print head towards the side of the discharge port in an opening state of the second printer cover by changing the position of the platen roller in relation to the opening and closing unit.

* * * * *